US005797057A

United States Patent [19]

Kinoshita et al.

[11] Patent Number: 5,797,057

[45] Date of Patent: Aug. 18, 1998

[54] METHOD OF WATER REPLENISHMENT FOR AN AUTOMATIC DEVELOPING APPARATUS AND DEVICE THEREFOR

[75] Inventors: Togo Kinoshita; Ryosuke Matsumoto, both of Wakayama-ken, Japan

[73] Assignee: Noritsu Koki Co., Ltd., Wakayama, Japan

[21] Appl. No.: 822,016

[22] Filed: Mar. 24, 1997

[30] Foreign Application Priority Data

Mar. 25, 1996 [JP] Japan ..... 8-067809
Mar. 25, 1996 [JP] Japan ..... 8-067929

[51] Int. Cl.[6] ..... G03D 3/02

[52] U.S. Cl. ..... 396/578; 396/636; 396/641; 396/631; 396/626

[58] Field of Search ..... 396/626, 630, 396/631, 636, 641, 578; 137/91, 93, 142, 454; 210/104, 195.2

[56] References Cited

U.S. PATENT DOCUMENTS 4,024,885 5/1977 Linthout ..... 137/91
4,323,381 4/1982 Becherer ..... 396/626
4,349,436 9/1982 Kaump ..... 210/104
4,641,941 2/1987 Yoshimi ..... 396/626
5,546,153 8/1996 Earle et al. ..... 396/626

FOREIGN PATENT DOCUMENTS 6-167794 6/1994 Japan ..... 396/942

*Primary Examiner*—D. Rutledge
*Attorney, Agent, or Firm*—Smith Patent Office

[57] ABSTRACT

A water replenishing device is disclosed which makes it possible to supply the necessary volume of water in response to a decrease in the processing solution in the processing tank due to evaporation. A water supply guide member is attached to an upper part of a processing solution tank. A discharge opening is formed at one end of the water supply guide member. Water supplied from a water replenishing pipe is fed to the water supply guide member and then it is supplied into the processing solution tank. When the processing solution level in the processing solution tank reaches an overflow opening, the excess water supplied to the water supply guide member is discharged outside the processing solution tank through the discharge opening.

15 Claims, 5 Drawing Sheets

METHOD OF WATER REPLENISHMENT FOR AN AUTOMATIC DEVELOPING APPARATUS AND DEVICE THEREFOR

BACKGROUND OF THE INVENTION

1. Field of the Invention

The present invention relates to a method and a device to replenish water into an automatic developing apparatus to develop photosensitive materials such as film, printing paper and the like.

2. Description of the Related Art

In an automatic developing apparatus various processing solutions for developing, leaching, fixing, stabilizing, etc., are filled in respective processing solution tanks and a photosensitive material is immersed in turn into those solutions for development. The solutions gradually decrease due to evaporation, so that when a solution level falls to a predetermined level, the water is replenished to keep the solution level constant.

In some cases water is manually replenished but this requires a significant amount of labor and sometimes the operator forgets to replenish the system. Therefore, a system with an automatic water replenishment feature is becoming popular.

One of the well know methods for automatic water replenishment is to use a device comprising a pipe for replenishing water. One end of the pipe is disposed above the processing solution tank or a sub-tank communicating with the tank and the other end of the pipe is connected to a tank for replenishing water. The device also includes a water pump incorporated with the pipe. The water pump is controlled by a level detector installed in the processing solution tank or the sub-tank so as to replenish water.

Instead of a level detector, another method wherein data such as ambient temperature, humidity, temperature of the processing solution and time are detected has been known. This system calculates the evaporated volume based on the detected data and a water pump is controlled to replenish the water.

SUMMARY OF THE INVENTION

In the water replenishing method using a level detector, if the level detector has a poor degree of accuracy, it is impossible to always replenish the optimum amount of water. When the volume of water replenished is insufficient, it causes a highly concentrated processing solution. Further, when the water is excessively replenished, the solution is diluted due to solution discharge through an overflow opening in the processing solution tank. Therefore, this method requires a level detector with a high degree of accuracy and this results in a high cost level detector.

On the other hand, using a water replenishing method where a water pump is controlled based on the detected data requires an exact data collection and calculating device with a high degree of accuracy also resulting in a high cost.

An object of the present invention is to provide a method and a device of an extremely simple construction to replenish the necessary volume of water into a processing solution tank of an automatic developing apparatus.

To solve the problem described above, a water replenishing method of the present invention for an automatic developing apparatus is provided with a processing solution tank and a water supply means to replenish water into the processing solution tank. The apparatus includes a water supply guide member to automatically switch the channel for the replenished water from the water supply means to guide the replenished water either to the processing solution tank or to the outside of the processing solution tank to discharge in response to the water level of the processing solution in the processing solution tank. The excess replenished water supplied from the water supply means is discharged outside the processing solution tank by the guide member when the water level of the processing solution goes up from the replenished water supplied from the water supply means and reaches a predetermined level.

A water replenishing device for an automatic developing apparatus is provided with a processing solution tank and a water supply means to replenish water into the processing solution tank. A water supply guide member is provided to automatically switch the channel to the replenished water from the water supply means to guide the replenished water either to the processing solution tank or to the outside of the processing solution tank to discharge in response to a water level change of processing solution in the processing solution tank. Thus, the excess replenished water supplied from the water supply means is discharged outside the processing solution tank by the guide member when the water level of the processing solution increases from the replenished water from the water supply means and reaches to the predetermined level.

Further, a water replenishing device of the present invention for an automatic developing equipment is provided with a processing solution tank having an overflow opening and a water supply means to replenish water into the processing solution tank from above. A vessel-shaped water supply guide member is provided in the processing solution tank so as to swing according to the water level change of the processing solution in the processing solution tank. The guide member tilts so that the water stored inside the vessel-shaped guide member flows toward the overflow opening when the processing solution level has reached the overflow opening. A discharge opening is disposed facing the overflow opening formed on the end of the water supply guide member. The water supplied by a water supply means is fed to the other end of the water supply member. The volume of replenished water from the water supply means is specified to be a volume of water, that is more than necessary, so that the water level of the processing solution reaches to the overflow opening.

As for the water supply guide member mentioned above, one end of the guide member may be located outside the processing solution tank so that the excess supplied water is discharged into a water replenishing tank installed outside the processing solution tank.

Furthermore, instead of the water supply guide member mentioned above which is supported to swing another construction may be adopted, wherein a spout-shaped water supply guide member is disposed obliquely slanted downward to one end of the guide member itself. The water supply member slides obliquely upward as the water level of the processing solution in the processing solution tank rises. After the processing solution level has reached the overflow opening level, the water supplied by the water supply means is fed onto the other end of the water supply guide member and is discharged outside the processing solution tank.

To add to those described above, the water supply guide member may be a funnel-shaped water supply guide member mounted slidably on the upper part of the overflow pipe which is provided in the processing solution tank and has an overflow opening on its upper end. The water supplied by a water supply means is fed to the water supply guide member and overflows into the processing solution tank. The water supply guide member rises as the processing solution level rises. Excessive water is discharged into the overflow pipe through the overflow opening after the level of the water stored in the water supply guide member has reached the overflow opening on the upper end of the overflow pipe.

Another water replenishing device of the present invention is provided with a processing solution tank having an overflow opening and a means to supply water into the processing solution tank from above. The water is replenished into the processing solution tank from the water supply means adopts such a construction where a water supply guide member is provided in the upper portion of the inside of the processing solution tank so that the water supply guide member guides the water supplied by the water supply means so as to form a stream of processing solution toward the overflow opening when the processing solution overflows. The volume of water replenished from the water supply means is specified to be the volume of excessively replenished water, that is more than necessary so that the water level of the processing solution reaches the overflow opening.

In those device constructions described above, water supply by the water supply means starts when the processing solution level in the processing solution tank falls to a predetermined level. The water volume to be supplied by the water supply means is specified to be an excessive volume, more than a predetermined level. For example, a volume which brings a higher water level than that for the overflow opening, so that the water supply continues even after the processing solution level has reached a predetermined level.

The excess supplied water is guided by a guide member of supplied water and is discharged outside the processing solution tank, so that the processing solution is protected from being discharged outside the processing solution tank.

BRIEF DESCRIPTION OF THE DRAWINGS

The above and other objects and features of the present invention will be clearly understood from the following description with respect to preferred embodiments thereof when considered in conjunction with the accompanying drawings, wherein the same reference numerals have been used to denote the same or similar parts or elements, and in which.

DETAILED DESCRIPTION OF THE PREFERRED EMBODIMENTS

Several embodiments of the present invention will now be described with reference to the drawings.

Figure 1:
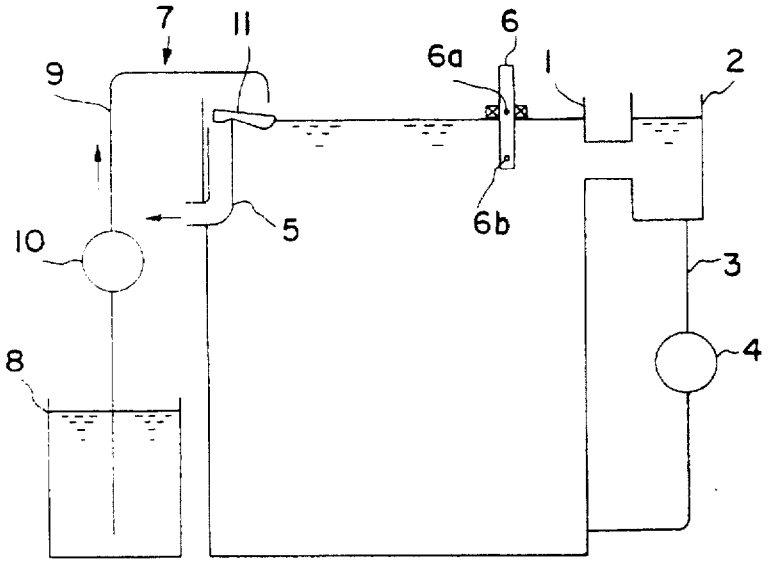
FIG. 1 is a schematic view of a processing solution tank, sub-tank and water replenishing tank according to a first embodiment of the present invention.
Figure 2:
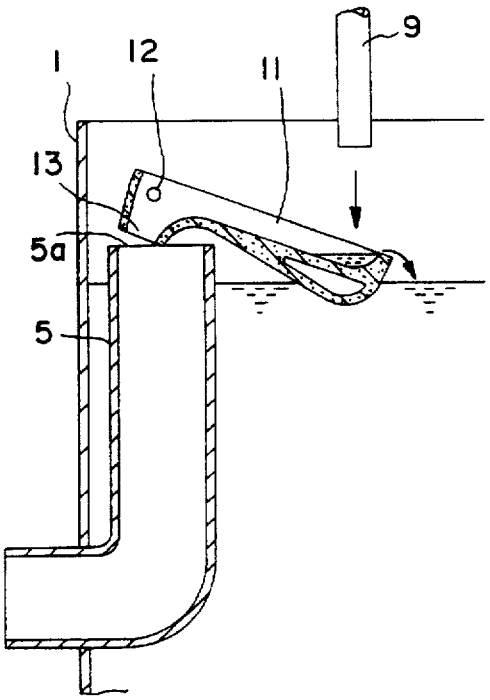
FIG. 2 is a cross sectional view of a water supply guide member according to the first embodiment of the present invention.
Figure 3:
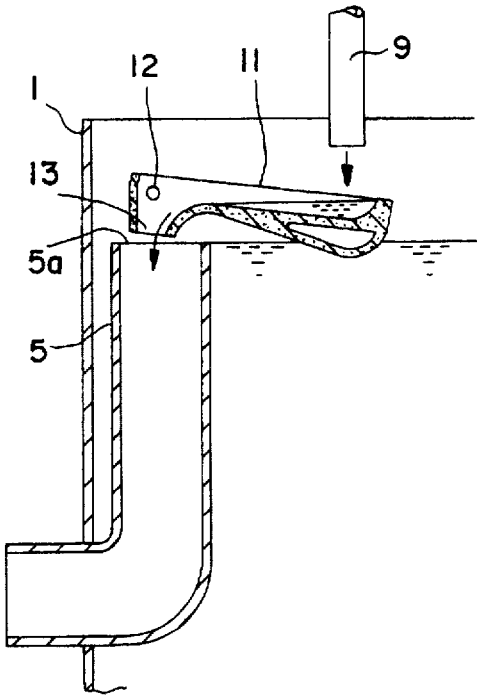
FIG. 3 is a cross sectional view of the water supply guide member of FIG. 2 discharging excess water into the overflow pipe of the first embodiment.

FIGS. 1, 2 and 3 show the first embodiment of the present invention. Outside a processing solution tank 1, a sub-tank 2 communicating with the upper part of the processing solution tank 1 is provided as illustrated.

The lower part of the sub-tank 2 and the lower part of the processing solution tank 1 are connected with each other through a circulation channel 3 in which a circulating pump 4 is installed.

The developing solution filled in the processing solution tank 1 and sub-tank 2 is circulated through both tanks 1 and 2 by the circulating pump 4, so as to make the temperature and the concentration of the developing solution uniform.

An overflow pipe 5 and a level detector 6 to detect the solution level are installed in the processing solution tank 1. The lower part of the overflow pipe 5 protrudes outside through the side wall of the processing solution tank 1.

At the outside of the processing solution tank 1 is a water supplying device 7 to replenish water into the tank. The water supply device 7 incorporates a water replenishing pump 10 in a water replenishing pipe 9. One end of the pipe 9 overhangs the processing solution tank 1 and the other end of the pipe 9 is connected to a water replenishing tank 8.

The water replenishing pump 10 is controlled by the level detector 6. The level detector 6 uses switches such as a float switch in which a ring float is mounted outside its supporting cylinder so as to go up or down according to the rise or fall of the processing solution level. A magnet is attached to the inner surface of the float and operates a pair of proximity switches installed respectively in the upper and lower portions inside of the supporting cylinder. An electrode switch comprising lower and upper limit detecting electrodes can also be used in place of the magnet.

Namely, the level detector 6 has two level detecting portions **6*a* and 6*b* to detect the upper and lower limit levels of the processing solution. The upper limit level detecting portion 6*a* of the level detector 6 is located a little bit lower than the overflow opening 5*a* of the overflow pipe 5**.

The level detector 6 starts to drive the water replenishing pump 10 when the processing solution level in the processing solution tank 1 falls to the lower limit level detecting portion **6*b***.

The upper limit level detecting portion **6*a* detects when the processing solution level rises nearly up to the overflow opening 5*a*. Then, after a specified period after detection, the water replenishing pump 10** is stopped.

The reason for the specified wait period is that a level detector 6 has a certain degree of accuracy. The level detector with a poor degree of accuracy might result in the water replenishing pump 10 stopping earlier or later than determined causing an insufficient or excessive amount of replenished water.

In those cases where the upper limit level detecting portion **6*a* of the level detector 6 is set equal to the level of the overflow opening 5*a***, a predetermined level of the processing solution might not be retained because the processing solution level might fall below the overflow opening Sa when the replenished water volume is insufficient.

To solve those problems described above, the upper level detecting portion **6*a* is set a little bit lower than the level of the overflow opening 5*a*. Further, the water replenishing pump 10 is stopped a specified period after the moment when the upper level detecting portion 6a has detected the processing solution level. Therefore, the water volume supplied by driving the water replenishing pump 10 exceeds the necessary volume required to raise the processing solution level from the lower limit level to that of the overflow opening 5a**.

In the upper portion of the processing solution tank 1, a vessel-shaped water supply guide member 11 is installed. The water supply guide member 11 has a pivot axis 12. The pivot axis 12 of the water supply guide member 11 is located above the overflow opening Sa of the overflow pipe 5 and is supported rotatably around the pivot axis 12.

A water discharge opening 13 is formed on the end of a pivot axis side of the water supply guide member 11 so as to face the overflow opening 5a and located above the other end of the water supply guide member 11 is an end of the water replenishing pipe 9.

In a water replenishing device constructed as above, if the level of the processing solution in the processing solution tank 1 falls due to evaporation, the other end of the water supply guide member 11 tilts downward. When the processing solution level falls to the lower limit level detecting portion 6b of the level detector 6, the water replenishing pump 10 starts to operate and the water in the water replenishing tank 8 is supplied through the water replenishing pipe 9 onto the water supply guide member 11 and subsequently overflows into the processing solution tank 1.

As the processing solution level in the processing solution tank 1 rises, the water supply guide member 11 rotates upward due to the buoyant force of the float 11a. When the processing solution level rises up to the overflow opening 5a, the water inside the water supply guide member 11 starts to flow into the discharge opening 13.

Since the water replenishing pump 10 is designed to stop after replenishing a larger volume of water than necessary, water supply continues even after the processing solution level rises up to the level of overflow opening 5a. The excessive water is discharged through the discharge opening 13 into the overflow opening 5a.

As described above, the discharge of excessive water from the overflow opening 5a before being mixed with the processing solution always secures the proper volume of water supply to the processing solution tank 1 so that the processing solution is not diluted.

The processing solution level in the processing solution tank 1 rises up to the upper level detecting portion 6a of the level detector 6 and the water replenishing pump 10 is stopped after a specified wait period following detection of this rise by the level detector 6. Since there is not a demand for a high degree of accuracy, it is possible to use a comparably inexpensive level detector 6 with a lower degree of accuracy.

Figure 4:
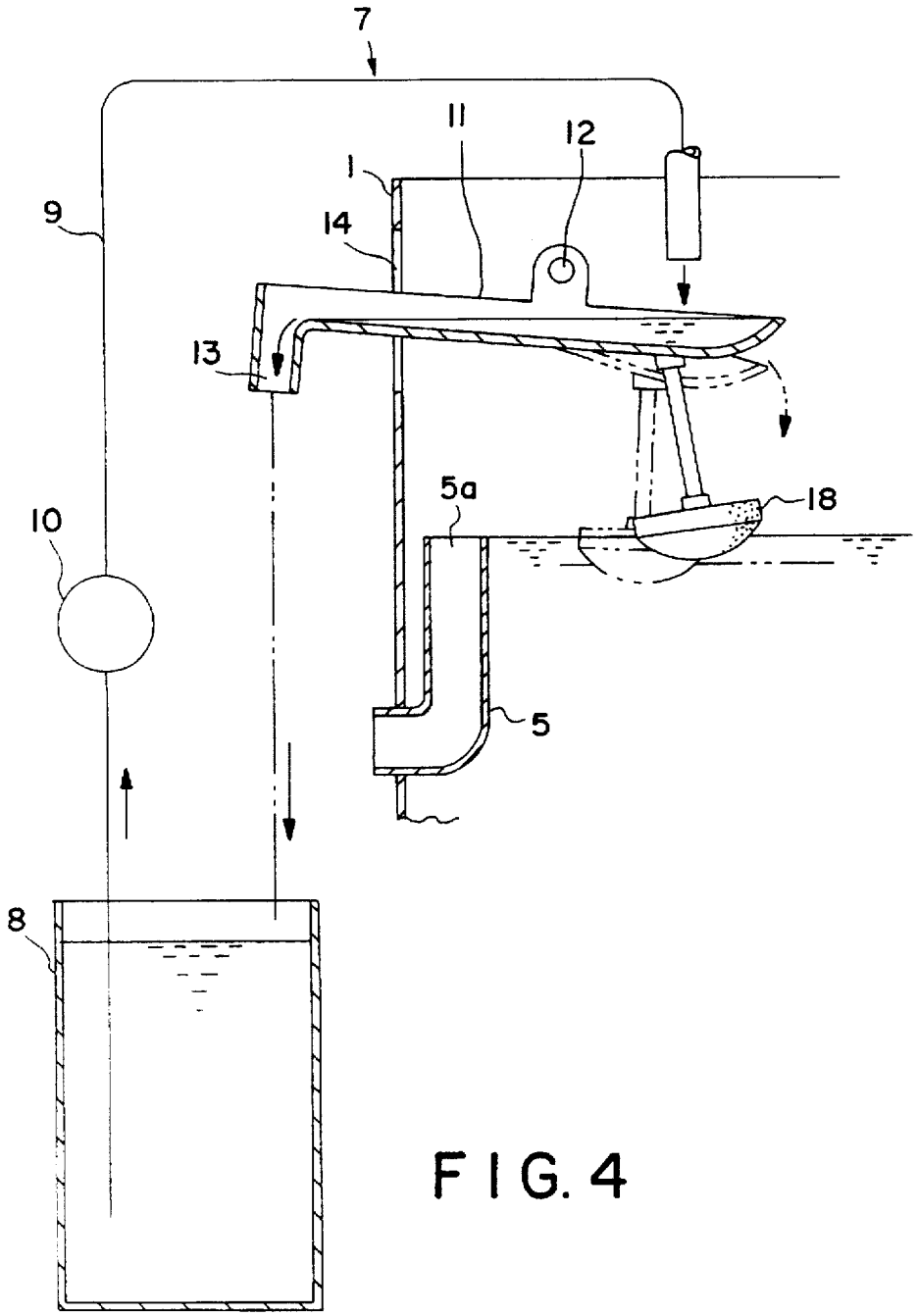
FIG. 4 is a cross sectional view of a second embodiment of a water supply guide member of the present invention.

FIG. 4 shows a second embodiment of the present invention. In this embodiment, some middle portion of the water supply guide member 11 is supported swingably around a pivotal axis 12, and one end of the water supply guide member 11 is formed as a discharge opening 13 and located outside the processing solution tank 1, passing through a window 14 formed on the side wall of the processing solution tank 1.

At the other end of the water supply guide member 11 is attached a float 18 which goes up and down according to the processing solution level change in the processing solution tank 1. Located above this end of the water supply guide member 11 is one end of a water replenishing pipe 9.

The other parts of the second embodiment are constructed the same as the first embodiment so that the same symbols will be used for the same components to avoid further explanation.

In the second embodiment described above, the water supplied from the water replenishing pipe 9 is fed onto the water supply guide member 11 and overflows from the other end of the water supply guide member 11 to replenish the processing solution tank 1.

Further, as the processing solution tank level rises, the water supply guide member 11 swings. After the processing solution level rises up to the overflow opening 5a, the excessive water supplied to the water supply guide member 11 is discharged through the discharge opening 13 into a water replenishing tank 8.

The second embodiment enables an effective use of water as the excess water supplied to the water supply guide member 11 is sent back to the water replenishing tank 8.

Figure 5:
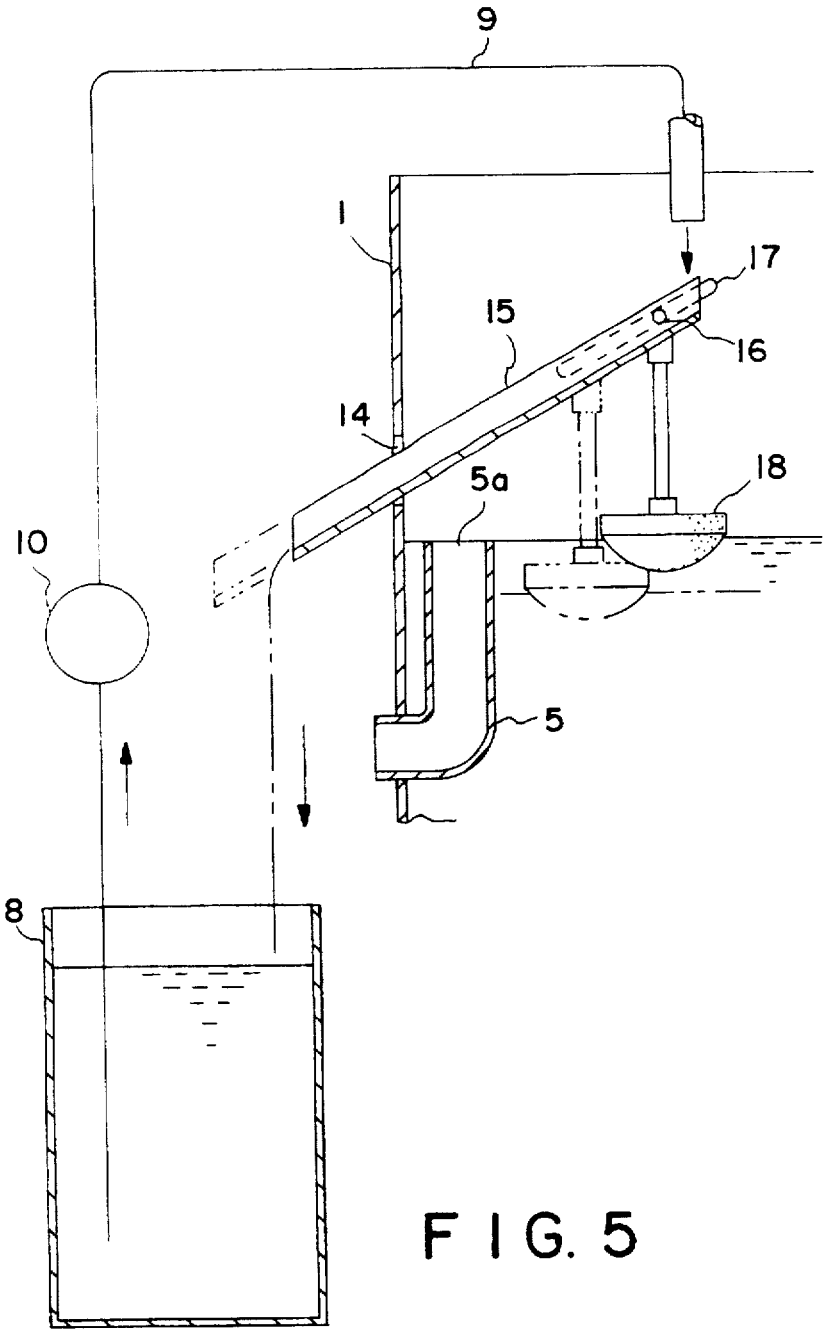
FIG. 5 is a cross sectional view of a third embodiment of a water supply guide member of the present invention.

FIG. 5 shows a third embodiment of the present invention. In this embodiment, one end of a spout-shaped water supply guide member 15 is disposed passing though a window 14 formed in the side wall of the processing solution tank 1. The water supply guide member 15 is slanted downward to one end. A pin 16 is provided at the other end of the water supply guide member 15 and is inserted so as to slide in a slanted oblong guide hole 17 formed on the side wall of the processing solution tank 1.

At the other end of the water supply guide member 15, a float 18 is attached which goes up and down according to the processing solution level in the processing solution tank 1. As the float 18 moves up and down, the water supply guide member 15 moves along the oblong guide hole 17, so that when the processing solution level rises up to the level of overflow opening 5a, the other end of the water supply guide member 15 comes to face one end of the water replenishing pipe 9.

In the third embodiment described above, the water supply guide member 15 moves obliquely downward as the processing solution level in the processing solution tank 1 falls. Further, the other end of the water supply guide member 15 moves out of position from facing the end of the water replenishing pipe 9.

Therefore, the water supplied through the water replenishing pipe 9 goes directly to replenish the processing solution tank 1.

As the processing solution level rises, the water supply guide member 15 moves upward obliquely. When the solution level rises up to the level of overflow opening 5a, one end of the water supply guide member 15 comes to face one end of the water replenishing pipe 9. The excess water supplied through the water replenishing pipe 9 is received by the water supply guide member 15 and flows along the slope of the water supply guide member 15 to be sent back to the water replenishing tank 8.

Figure 6:
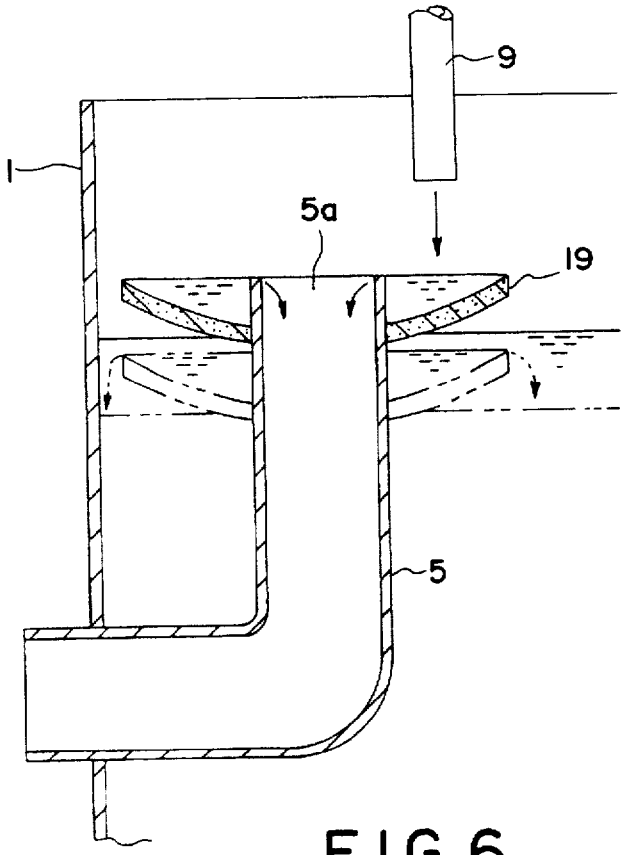
FIG. 6 is a cross sectional view of a fourth embodiment of a water supply guide member of the present invention.

FIG. 6 shows a fourth embodiment of the present invention. In this embodiment, a funnel-shaped water supply guide member 19 is attached at the upper end of the overflow pipe 5 so that it can slide freely up and down. The water supplied from the water replenishing pipe 9 is fed onto the outer circumferential part of the water supply guide member 19.

The other parts of the fourth embodiment are constructed the same as the first embodiment, so that the same reference numerals will be used for the same components to avoid further explanation.

In the fourth embodiment described above, the water supplied from the water replenishing pipe 9 is fed onto the water supply guide member 19 and overflows from the outer circumference of the water supply guide member 19 to replenish the processing solution tank 1.

The water supply guide member 19 which is made of a formed material covered with an outer skin is raised as the processing solution level rises until the level of water stored in the water supply guide member 19 reaches to that of the overflow opening 5*a*. Then the excess water is supplied from the water replenishing pipe 9 onto the water supply guide member 19 and is discharged from the overflow opening into the overflow pipe 5.

Also in the fourth embodiment described above, no dilution of the processing solution takes place at all as the excessive water supplied is discharged outside the processing solution tank 1 before being mixed with the processing solution.

Figure 7:
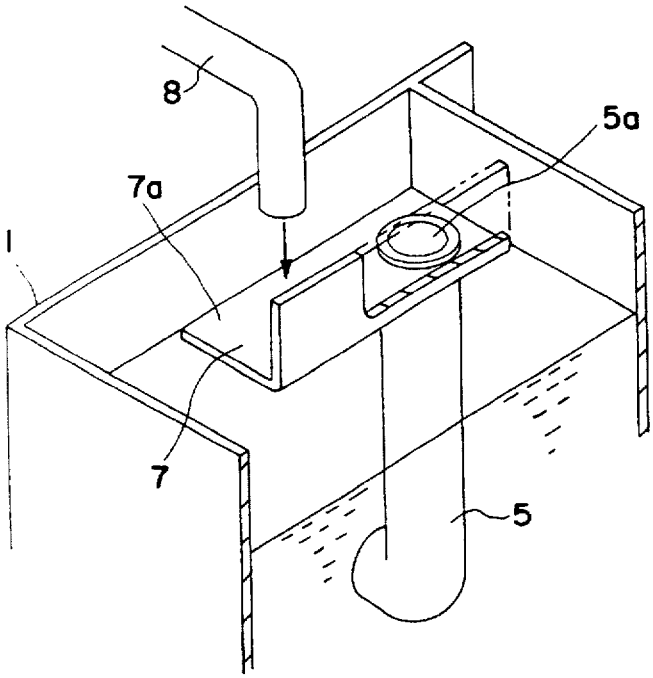
FIG. 7 is a perspective view of a main part of a water supply guide member according to a fifth embodiment of the present invention.

FIG. 7 shows a fifth embodiment of the present invention. In this embodiment, the upper end of the overflow pipe 5 penetrates through a bottom plate 7*a* of a spout-shaped water supply guide member 7 provided at the upper portion of the processing solution tank 1. The overflow pipe 5 protrudes a bit out of the bottom plate 7*a*. Reference numeral 5*a* designates the upper overflow opening of the overflow pipe 5.

The water supplied from the water replenishing pipe 8 onto the water supply guide member 7 does not flow into the overflow opening 5*a* but flows along the water supply guide member 7 and into the processing solution tank 1, because the upper end of the overflow pipe 5 protrudes a bit higher out of the bottom plate 7*a* of the water supply guide member 7.

When the processing solution level in the processing solution tank 1 rises up to the level of the overflow opening Ba, a processing solution stream flows to the overflow opening 5*a* and the excess water additionally supplied after this moment is discharged out through the overflow opening 5*a* because it is fed into the stream and flows along with the stream over the water supply guide member 7 without flowing out of the water supply guide member 7.

As described above, the discharge of excess water through the overflow opening 5*a* before being mixed with processing solution always allows the best volume of water to be replenished into the processing solution tank 1 and no dilution of processing solution takes place.

Figure 8:
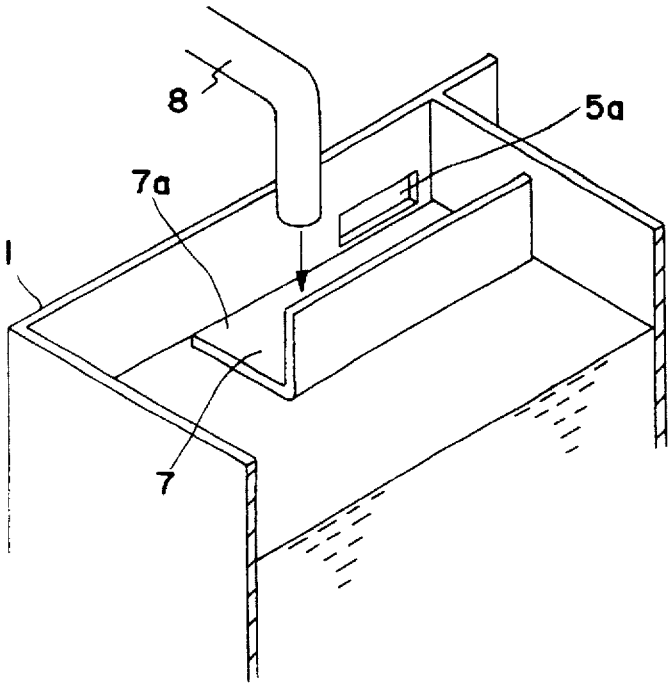
FIG. 8 is a perspective view of a main part of a water supply guide member according to a sixth embodiment of the present invention.

In the embodiment shown in FIG. 7, the excessive water is discharged outside the processing solution tank 1 through the overflow pipe 5 which penetrates the bottom plate 7*a* of the water supply guide member 7. The excessive water may also be discharged through an overflow opening 5*a* which is formed in a side wall of the processing solution tank 1 above the bottom plate 7*a* of the water supply guide member 7, as shown in FIG. 8.

The embodiments described above are so constructed that a solution level detector 6 is provided to control a water replenishing pump 10, but they allow a larger volume of water than necessary to be replenished. Therefore, a predetermined volume of water may be replenished at a specified time without providing any particular solution level detector.

Regarding the embodiments described above, the explanations have been made about how to replenish water into a processing solution tank, but the invention is also applicable to replenishing water into a sub-tank.

The present invention secures a necessary volume of water to be replenished into a processing solution tank by replenishing water into the processing solution tank by a water supply means, and discharging the excess water supplied by the means outside the processing solution tank through a water supply guide member after the processing solution level in the processing solution tank has reached a predetermined level.

Therefore, the concentration of the processing solution can be controlled so that it is neither too thick nor diluted and is otherwise kept constant. The present invention provides an inexpensive water replenishing device because of its simple construction with a water supply guide member installed in a processing solution tank.

It is to be understood that although the present invention has been described with regard to preferred embodiments thereof, various other embodiments and variants may occur to those skilled in the art, which are within the scope and sprit of the invention, and such other embodiments and variants are intended to be covered by the following claims.

What is claimed is:

1. A water replenishing method for an automatic developing apparatus having a processing solution tank and a water supply means to replenish water into the processing solution tank, comprising the steps of:

providing a water supply guide member for automatically switching the replenished water from the water supply means to guide the replenished water to at least one of the processing solution tank and outside the processing solution tank in response to a water level change of processing solution in the processing solution tank; and discharging the excess replenished water supplied from the water supply means outside the processing solution tank by the water supply guide member when the water level of the processing solution goes up by the water replenished from the water supply means after the processing solution reaches a predetermined level.

2. A water replenishing method as defined in claim 1, further comprising the step of:

switching where the replenished water is directed in response to a buoyant force from the processing solution.

3. A water replenishing method as defined in claim 1, further comprising the step of:

supplying water from the water supply means onto the water supply guide member.

4. A water replenishing method as defined in claim 1, further comprising the step of:

starting the supply of replenishing water from the water supply means when the volume of processing solution has decreased to a predetermined level, and stopping the supply of water after having replenished a sufficient volume of water so that the solution level reaches a predetermined level.

5. A water replenishing device for an automatic developing apparatus comprising:

a processing solution tank;

a water supply means to replenish water into said processing solution tank;

a water supply guide member provided to automatically switch a channel for the replenished water from said water supply means to guide the replenished water to at least one of said processing solution tank and outside said processing solution tank to discharge in response to a water level change of the processing solution in said processing solution tank so that excess replenished water supplied from said water supply means is discharged outside the processing solution tank by said water supply guide member when a water level of the processing solution goes up by replenished water from said water supply means and reaches a predetermined level.

6. A water replenishing device as defined in claim 5, wherein said processing solution tank is provided with an overflow opening to discharge processing solution outside said processing solution tank when the processing solution level rises above a certain level.

7. A water replenishing device as defined in claim 6, wherein said water supply guide member is constructed to guide excess replenished water supplied from said water supply means into the overflow opening.

8. A water replenishing device as defined in claim 5, wherein said processing solution tank comprises a level detector to detect a water level of processing solution; and said level detector sends a signal when the processing solution level falls below a predetermined level so that said water supply means starts to supply water in response to said signal.

9. A water replenishing device for an automatic developing apparatus comprising:

a processing solution tank having an overflow opening;

a water supply means to replenish water into said processing solution tank from above;

a vessel-shaped water supply guide member located in an upper portion of said processing solution tank to move according to a water level change of processing solution in said processing solution tank and to tilt so that the water stored inside said vessel-shaped water supply guide member flows toward the overflow opening when the processing solution level has reached the overflow opening;

a discharge opening is provided opposing the overflow opening formed on an end of said water supply guide member;

water supplied by said water supply means is fed onto the other end of said water supply guide member; and an amount of replenished water from said water supply means is specified to be an amount that will result in excess replenished water being supplied so that the water level of processing solution reaches the overflow opening.

10. A water replenishing device as defined in clam 9, wherein said water supply guide member is provided with a float.

11. A water replenishing device as defined in claim 9, wherein one end of said water supply guide member is located outside said processing solution tank.

12. A water replenishing device for an automatic developing apparatus comprising:

a processing solution tank having an overflow opening;

a water supply means to replenish water into said processing solution tank from above;

said processing solution tank has an opening formed in an upper side wall;

a spout-shaped water supply guide member is disposed obliquely slanted downward at one end of said guide member, an end of said water supply guide member passing through the opening in said upper side wall so as to locate a portion of said water supply guide member outside said processing solution tank, said water supply guide member being supported so as to slide obliquely;

a float is attached to said water supply guide member so that said water supply guide member slides up and down according to a water level change of the processing solution;

a water supply outlet of said water supply means is disposed facing above another end of said water supply guide member when said water supply guide member is in an upper limit standstill position; and an amount of replenished water from said water supply means is specified to be an amount that will result in excess replenished water being supplied so that the water level of processing solution reaches the overflow opening.

13. A water replenishing device for an automatic developing apparatus comprising:

a processing solution tank having an overflow pipe which has an overflow opening on its upper end;

a water supply means to replenish water into the processing solution tank from above;

a funnel-shaped water supply guide member attached on an upper end of said overflow pipe so as to slide up and down along said overflow pipe as a water level of processing solution in said processing solution tank changes;

a water supply outlet of said water supply means is disposed so as to face an outer circumferential part of said water supply guide member; and an amount of replenished water from said water supply means is specified to be an amount that will result in excess replenished water being supplied so that the water level of water stored in said water supply guide member reaches an overflow opening on an upper end of said overflow pipe.

14. A water replenishing device for an automatic developing apparatus comprising:

a processing solution tank having an overflow opening;

a water supply means to replenish water into the processing solution tank from above and is replenished with water by said water supply means;

a water supply guide member is provided at an upper portion of an inside of said processing solution tank to direct the water supplied by said water supply means over the processing solution in said processing tank so as to form a processing solution stream toward the overflow opening when a processing solution overflow takes place; and an amount of replenished water from said water supply means is specified to be an amount that will result in an excess amount of replenished water being supplied so that the water level of processing solution reaches the overflow opening.

15. A water replenishing device as defined in claim 14, wherein said water supply guide member comprises a water replenishment spout horizontally attached to the upper portion of the inside of said processing solution tank; and the overflow opening protrudes over a bottom plate of said water supply guide member.

* * * * *